US009856611B2

(12) United States Patent
Heusinger et al.

(10) Patent No.: US 9,856,611 B2
(45) Date of Patent: Jan. 2, 2018

(54) APPARATUS FOR PRODUCING FOAMED BITUMEN AND METHOD FOR ITS MAINTENANCE

(75) Inventors: Juergen Heusinger, Koblenz (DE); Andreas Nacke, Dessighofen (DE); Thorsten Jörig, Mermuth (DE)

(73) Assignee: BOMAG GmbH, Boppard (DE)

( * ) Notice: Subject to any disclaimer, the term of this patent is extended or adjusted under 35 U.S.C. 154(b) by 166 days.

(21) Appl. No.: 13/633,946

(22) PCT Filed: Apr. 6, 2011

(86) PCT No.: PCT/EP2011/001710
§ 371 (c)(1),
(2), (4) Date: Jan. 2, 2013

(87) PCT Pub. No.: WO2011/124369
PCT Pub. Date: Oct. 13, 2011

(65) Prior Publication Data

US 2013/0114367 A1 May 9, 2013

(30) Foreign Application Priority Data

Apr. 6, 2010 (DE) ..... 10 2010 013 982

(51) Int. Cl.
*E01C 19/00* (2006.01)
*E01C 19/16* (2006.01)
(Continued)

(52) U.S. Cl.
CPC ..... *E01C 19/16* (2013.01); *B05B 15/02* (2013.01); *B05B 15/025* (2013.01); *B08B 5/02* (2013.01);
(Continued)

(58) Field of Classification Search
CPC .... B01F 13/0244; E01C 23/065; E01C 19/16; E01C 19/17; B05B 15/025
(Continued)

(56) References Cited

U.S. PATENT DOCUMENTS 2,690,976 A 10/1954 Bartleson et al.
3,782,634 A 1/1974 Herman
(Continued)

FOREIGN PATENT DOCUMENTS

CN 201082956 Y 7/2008
CN 201092654 Y 7/2008
(Continued)

OTHER PUBLICATIONS espacenet.com, English Machine Translation of Application No. WO9624725A1, published Aug. 15, 1996, retrieved from http://worldwide.espacenetcom on Sep. 30, 2012 (9 pages).
(Continued)

*Primary Examiner* — Tony G Soohoo
*Assistant Examiner* — Anshu Bhatia
(74) *Attorney, Agent, or Firm* — Wood Herron & Evans LLP

(57) ABSTRACT

The present invention relates to an apparatus for producing foamed bitumen for a road construction machine, comprising at least one mixing device having a reaction chamber, in which hot bitumen and at least one reaction fluid can be mixed together via an inlet device comprising at least one inlet nozzle and can be discharged from the mixing device via an outlet device, with at least one compressed-air device being provided, via which the inlet device and/or the outlet device can be subjected to a compressed-air stream for testing and/or cleaning purposes. The present invention further also relates to a method for maintaining such an apparatus.

15 Claims, 3 Drawing Sheets

(51) Int. Cl.

| | |
|---|---|
| ***B05B 15/02*** | (2006.01) |
| ***C10C 3/00*** | (2006.01) |
| ***E01C 19/17*** | (2006.01) |
| ***E01C 23/06*** | (2006.01) |
| ***B08B 5/02*** | (2006.01) |

(52) U.S. Cl.
CPC ..... *C10C 3/00* (2013.01); *E01C 19/17* (2013.01); *E01C 23/065* (2013.01)

(58) Field of Classification Search
USPC ..... 366/10, 11, 107
See application file for complete search history.

(56) References Cited

U.S. PATENT DOCUMENTS

| | | | | |
|---|---|---|---|---|
| 4,783,268 | A * | 11/1988 | Leung | C10G 1/047 208/391 |
| 4,990,025 | A | 2/1991 | Young et al. | |
| 5,279,500 | A | 1/1994 | Perrin et al. | |
| 5,385,426 | A | 1/1995 | Omann | |
| 5,895,173 | A | 4/1999 | O'Brien et al. | |
| 6,000,630 | A | 12/1999 | Takenawa | |
| 6,565,281 | B2 | 5/2003 | Bruns et al. | |
| 6,802,464 | B2 | 10/2004 | Marconnet | |
| 7,556,715 | B2 | 7/2009 | Gaston et al. | |
| 7,591,310 | B2 | 9/2009 | Minderhoud et al. | |
| 7,914,670 | B2 * | 3/2011 | Gaston et al. | 208/390 |
| 2001/0022919 | A1 * | 9/2001 | Bruns | B05B 15/0208 404/91 |
| 2003/0194273 | A1 | 10/2003 | Lloyd | |
| 2005/0150816 | A1 * | 7/2005 | Gaston et al. | 208/39 |
| 2005/0168048 | A1 | 8/2005 | Gaertner et al. | |
| 2008/0092777 | A1 | 4/2008 | Matthews | |
| 2008/0129103 | A1 | 6/2008 | Hall et al. | |
| 2008/0193215 | A1 | 8/2008 | Rath | |
| 2009/0052987 | A1 | 2/2009 | Hall et al. | |

FOREIGN PATENT DOCUMENTS

| | | | |
|---|---|---|---|
| DE | 2161705 | A1 | 8/1972 |
| DE | 29702162 | U1 | 6/1998 |
| DE | 10213017 | A1 | 10/2003 |
| DE | 102 41 067 | B3 | 4/2004 |
| EP | 0860551 | A2 | 8/1998 |
| EP | 0960239 | A1 | 12/1999 |
| JP | 2004-003200 | A | 1/2004 |
| JP | 2005-342683 | A | 12/2005 |
| JP | 2006-007136 | A | 1/2006 |
| WO | 95/22661 | A1 | 8/1995 |
| WO | 96/24725 | A1 | 8/1996 |
| WO | 00/60172 | A1 | 10/2000 |

OTHER PUBLICATIONS espacenet.com, Abstract, English Machine Translation of Japanese Application No. JP2004003200A, published Jan. 8, 2004, retrieved from http://worldwide.espacenet.com on Sep. 30, 2012 (2 pages).
espacenet.com, English Machine Translation of Application No. DE10241067B3, published Apr. 22, 2004, retrieved from http://worldwide.espacenet.com on Sep. 30, 2012 (9 pages).
espacenet.com, Abstract, English Machine Translation of Japanese Application No. JP2005342683A, published Dec. 15, 2005, retrieved from http://worldwide.espacenet.com on Sep. 30, 2012 (2 pages).
espacenet.com, Abstract, English Machine Translation of Japanese Application No. JP2006007136A, published Jan. 12, 2006, retrieved from http://worldwide.espacenet.com on Sep. 30, 2012 (2 pages).
espacenet.com, Abstract, English Machine Translation of Chinese Application No. CN201092654Y, published Jul. 30, 2008, retrieved from http://worldwide.espacenet.com on Sep. 30, 2012 (1 page).
European Patent Office, International Search Report, International Application No. PCT/EP2011/001710, dated Apr. 10, 2012 (3 pages).
espacenet.com, Abstract, English Machine Translation of Application No. WO9522661A1, published Aug. 24, 1995, retrieved from http://worldwide.espacenet.com on Sep. 30, 2012 (2 pages).
Espacenet, English Machine Translation of CN201082956Y, published Jul. 9, 2008, retrieved from http://worldwide.espacenet.com on Nov. 6, 2014 (6 pages).
Espacenet, English Machine Translation of German Application No. DE2161705A1, published Aug. 10, 1972, retrieved from http://worldwide.espacenet.com on Mar. 28, 2014.
Espacenet, English Machine Translation of German Application No. DE10213017A1, published Oct. 9, 2003, retrieved from http://worldwide.espacenet.com on Mar. 28, 2014.

* cited by examiner

APPARATUS FOR PRODUCING FOAMED BITUMEN AND METHOD FOR ITS MAINTENANCE

CROSS-REFERENCE TO RELATED APPLICATIONS

The present application is a submission under 35 U.S.C. §371 of International Application No. PCT/EP2011/001710, filed Apr. 6, 2011, which claims priority to German Application No. 10 2010 013 982.3, filed Apr. 6, 2010, the disclosures of which are hereby expressly incorporated by reference herein in their entireties.

FIELD OF THE INVENTION

The present invention relates to an apparatus for producing foamed bitumen for a road construction machine, comprising at least one mixing device having a reaction chamber, in which hot bitumen and at least one reaction fluid can be mixed together via an inlet device comprising at least one inlet nozzle and can be discharged from the mixing device via an outlet device.

The present invention further relates to a method for maintaining such an apparatus.

BACKGROUND OF THE INVENTION

Such apparatuses are required in road construction machines, for example, and especially in recycling machines for road construction. Such a road construction machine has been described, for example, in WO 96/24725. It comprises a rotation chamber in which a revolving working roller is arranged, which is usually arranged in a height-adjustable and inclination-adjustable manner for adjustment to the surface to be processed. In this rotation chamber, an existing road surface is milled off, the milled material is crushed, bonding agents and especially foamed bitumen are added, and the material is mixed, distributed and supplied to an applying apparatus for forming a new road surface.

An apparatus for producing such a bonding agent and especially foamed bitumen for road construction machines is known from WO 95/22661. The apparatus comprises at least one reaction chamber in which a mixing device is provided in which hot bitumen at a temperature of 180° C. and water can be mixed together via injection nozzles under pressure. The apparatus comprises a heatable foam reactor and heatable feed and distributor lines, wherein the lines can additionally be insulated. Several nozzles are arranged next to one another along a distributor line. This distributor line is connected with a central foam reactor via a line network, in which the foamed bitumen is produced for all nozzles. An agitator is further arranged in this foam reactor. The disadvantage of this apparatus is that the foam reactor is disposed far away from the injection nozzles and the already mixed foamed bitumen will partly disintegrate on its way to the nozzles, so that, among other things, precise dosing of the foam is not possible.

In the production of foamed bitumen or similarly foamed bonding agents, hot bitumen, reaction water and optionally air are preferably injected into a mixing device or a reaction chamber of the road construction machine which is arranged therein and injected from there directly into the rotation chamber. The common injection leads to a mixing of the individual substances in the reaction chamber. During the injection and the contact with the hot bitumen the water will evaporate immediately and will lead to the formation of foamed bitumen and thus to the desired increase in the volume of the bonding agent. The distribution of the water is improved by the addition of air to the hot bitumen and the reaction water, so that the foam quality improves. The finished foamed bitumen can enter the rotation chamber of the road construction machine from the reaction chamber and the mixing device which is arranged therein, where it is then mixed with the raw road material. This finished material mixture is then applied to a substructure as a new road surface by way of respective application and smoothing devices.

The mixing device therefore comprises a reaction chamber, into which at least parts of an inlet device and an outlet device will open, for example, a plurality of separate inlet nozzles for each reaction material to be processed into foamed bitumen. Hence, usually at least one water nozzle, one bitumen nozzle and, in the case of separate introduction of air, also one air nozzle are therefore provided. The outlet device usually comprises a fluidic connection from the reaction chamber to the rotation chamber of the road construction machine, with an injection nozzle also being used in this case by means of which the readily mixed foamed bitumen is sprayed into the rotation chamber.

The entire reaction chamber, including the inlet and outlet devices, is in contact with bitumen during the production of the foamed bitumen. When the device is at a standstill, e.g., during breaks, after ending the work or during maneuvering processes of the machine, the danger therefore is that by cooling and hardening of the bitumen the inlet and outlet devices, and especially the provided injection nozzles, will get clogged and will no longer work upon re-start.

The danger of clogging is also given for the injection nozzle of the finished foamed bitumen or a similar component by means of which the foamed mixture is supplied to the rotation chamber of the road construction machine and comes into contact with the cold milling material.

In the case of low injection quantities, which are usually accompanied by a low injection pressure or partly deactivated nozzles, it can principally occur that the nozzles will be blocked by material from the outside and will be clogged. There are different consequences to this. For example, the finished foamed bitumen is not foamed or not sufficiently foamed by a lack of reaction water or a lack of reaction air, depending on which of the nozzles of the inlet device are clogged. The foam quality is consequently reduced. This has a direct influence on the finished road construction material, the quality of which is influenced negatively. In the region of the outlet device, the clogging of the outlet nozzle, for example can lead to bright strips in the mixing material or regions in which there is no bonding agent at all in the milling material.

Hitherto, the function of the devices can hardly be monitored because of the difficult accessibility to the inlet and outlet devices and especially to any nozzles within the rotation chamber or within the reaction chambers.

An apparatus is known from the prior art which intends to remedy this problem. DE 102 41 067 B3 describes an apparatus for producing foamed bitumen which comprises a stripping device on the respective inlet nozzles by means of which clogged nozzles can be "scraped free".

DE 297 02 162 U1 describes an apparatus for producing foamed bitumen, in which a pressure journal is provided for each nozzle for cleaning potentially clogged nozzles, which journal is able to punch through any possibly clogged nozzle. The disadvantageous aspect is that complex routing of lines is necessary in order to provide space for the cleaning cylinder. For this purpose, the foamed bitumen needs to be redirected at first to a kind of a secondary chamber before then exiting into the rotation chamber of the road construction machine. The foam may lose some of its quality already by this redirection.

The initially described apparatuses therefore come with the disadvantage that the cleaning apparatuses for the inlet and outlet devices, especially for clogged nozzles, require a very complex construction, with a preceding test for perfect functioning of the inlet and outlet devices not being possible at all. Malfunctions and lack of quality of the finished product are the consequence.

SUMMARY OF THE INVENTION

The present invention is therefore based on the object of providing an apparatus for producing foamed bitumen which allows a more reliable production of foamed bitumen and in addition is more cost-effective and reliable in production and operation.

This object is especially achieved by an apparatus for producing foamed bitumen for a road construction machine, comprising at least one mixing device having a reaction chamber in which hot bitumen and at least one reaction fluid can be mixed together by an inlet device comprising at least one inlet nozzle and can be discharged from the mixing device by means of an outlet device, with at least one compressed-air device being provided, via which the inlet device and/or the outlet device can be subjected to a compressed-air stream for testing and/or cleaning purposes.

At the process level, this object is achieved by a method for maintaining an apparatus according to the kind as described above, comprising the following steps of a testing process:

supplying the inlet and/or outlet devices with a compressed-air stream;

detecting a pressure curve of the compressed-air stream in the inlet and/or outlet device, and comparing the detected pressure curve with a predetermined reference pressure curve, with any deviation of the pressure curve from the reference pressure curve indicating a malfunction and especially clogging of the inlet and/or outlet device.

Foamed bitumen shall be understood within the scope of the present invention as any material that is used as a road or other ground surface and is prepared in a respective apparatus. This includes, among other things, foamed bitumen, bitumen per se, foamed tar or similar bonding agents. The term "hot bitumen" shall therefore be understood as being any bonding agent which during a break or principally after a certain period of time changes its aggregate state from fluid to solid or to such a state which clogs the previously described inlet or outlet devices. The terms of inlet and outlet device shall be understood to be an assembly of components which are used for guiding the respective reaction products or components to and from the respective chambers, especially line systems with main and secondary lines, nozzles, valves, locks, etc. The term "compressed air" shall be understood to be any fluid, but preferably breathable air, which can be transported via the inlet or outlet devices and is suitable for supplying the inlet and outlet devices by means of a respective pressure apparatus. Fluids with respective cleaning additives can also be used, with the cleaning additives being supplied, for example, by a cleaning agent device to a compressed-air stream.

In contrast to the apparatuses known from the prior art, a compressed-air device is used in accordance with the present invention, which is arranged in such a way that it allows supplying compressed air to the inlet and/or outlet device of the reaction chamber and optionally to further components that come into contact with bitumen. It can thus be checked especially in connection with suitable measuring instruments whether certain parts of the inlet or outlet devices and especially whether certain nozzles of the respective devices are clogged and, depending on the respectively used measuring devices, the extent to which they are clogged. Moreover, such an apparatus allows cleaning the components that come into contact with the bitumen, as will be explained below in closer detail, and especially the inlet and outlet device in order to remove bitumen or similar residues in a preventive manner or in the case of clogging.

In order to check the functionality of the inlet device, it is supplied, for example, with a specific compressed-air stream. If the resulting pressure does not drop within the inlet device over a specific period of time or does so only very slowly, then this indicates that there is a clogged component in the inlet device. The same also applies to the outlet device. The extent to which there is clogging can be concluded on the basis of the duration of the pressure decrease.

Preferably, the detection of clogging or the detection of the flawless functionality occurs by a comparison of a reference pressure curve with the actually detected pressure curve. The pressure curve is determined, for example, in a flawlessly functioning machine and is stored in a machine memory, so that a newly detected pressure curve can be compared with it. If a specific deviation occurs, this allows drawing conclusions on a malfunction and especially clogging of the respective devices.

The inlet and/or outlet devices are preferably successively supplied with a compressed-air stream in the above testing process, i.e., when checking whether the inlet and/or outlet devices are unclogged. This means that at first the entire inlet device and then the outlet device are supplied with compressed air, for example. Since usually the inlet and outlet devices also consist of several elements and especially of a plurality of inlet nozzles and outlet nozzles, the supply with compressed air occurs successively in this case too. Thus, there is preferably an individual supply of such small groups of components that it is possible to locate a fault in a relatively precise manner.

For example, a potential road construction machine consists of a total of 20 reaction chambers switched in parallel, the inlet devices of which each comprise a line system with a main line from a central reaction product reservoir, i.e., a bitumen reservoir, a water reservoir, etc., and secondary lines which branch off from the same and which each lead to a bitumen nozzle, water nozzle or air nozzle facing towards the reaction chamber. This total number of 60 nozzles of the inlet devices is supplied in accordance with one embodiment of the present invention successively with compressed air in the testing process. As soon as a deviation of the detected pressure curve is measured from the previously determined reference pressure curve in a nozzle, cleaning measures can be initiated for the respective nozzles regarded as being "clogged" or "partly clogged".

Preferably, the steps of the testing process are automatically performed when detecting an operating break and/or the end of operation or a similar operating state of the apparatus and/or when the temperature drops beneath a specific component temperature. Such operating breaks frequently lead to the solidifying or hardening of the material contained in the rotation chamber or reaction chamber of the apparatus and thus to an increase in the likelihood of the clogging of the respective device. The likelihood of clogging is also increased when a specific component temperature of the apparatus, for example, the respective nozzle temperature of the inlet or outlet devices, drops beneath a certain value. As soon as such an operating state is detected by means of respective sensor devices, the testing process is started in accordance with the present invention in order to prevent a malfunction of the machine. Since it is easily possible to clean potentially clogged inlet or outlet devices especially when hardening has just commenced, the "early" initiation of such a method is advantageous.

Preferably, a cleaning process is performed upon detecting a malfunction in the testing process and/or preventively, with all or also individual inlet or outlet devices being supplied with a compressed-air stream simultaneously. It is possible, for example, to supply all inlet devices simultaneously and then all outlet devices simultaneously or both devices simultaneously with a compressed-air stream. This removes bitumen and similar raw material residues both from the inlet and outlet devices as well as the reaction chamber and possibly the rotation chamber, so that clogging that has possibly started can be removed and clogging can principally be prevented. When there is actual clogging the respective inlet or outlet device can be "cleared by blowing". It is obviously also possible to supply individual nozzles with a blast in order to thus achieve the cleaning of specific clogged nozzles.

It is principally obviously possible to provide such a cleaning function also manually if necessary. It is further possible to automatically perform the cleaning function after the start of the work, after a break or a similar operating state in order to ensure functionality of the machine and to prevent clogging. It is useful to perform such a cleaning function also when detecting a break or a similar operating state because it is then possible to prevent clogging already in advance. It is principally also possible to perform a cleaning process as a first method step by preferably simultaneously supplying the inlet and/or outlet devices with compressed air and especially with compressed-air blasts and to have the testing process performed only in a second method step in order to verify whether the cleaning process was successful. The subsequent testing process ensures that the "cleaned" apparatus will function perfectly, and the prior cleaning process guarantees that a) the existing clogging is removed and b) the waste material is removed prior to hardening and the danger of clogging is thus reduced.

A testing process can performed in the following manner, for example. A common compressed-air feed pipe which is in fluidic connection with the reaction water, bitumen and reaction air nozzles is supplied with compressed air up to a specific maximum level or testing pressure. During automatic testing, all reaction water and reaction air nozzles of the inlet device are successively opened individually and the change in the testing pressure is monitored with a pressure sensor. If a defined pressure drop, i.e., a pressure curve in conformity with a reference pressure curve, occurs within a predetermined period of time, the nozzle is not clogged and therefore functional. If the testing pressure remains, however, or if the reference pressure is not reached within the predetermined period of time, a clogged reaction water or reaction air nozzle or a clogging of the downstream foam nozzle, i.e., the outlet device, can be assumed. Since this procedure is performed individually for all reaction water, bitumen and reaction air nozzles, it is possible to precisely detect the reaction chamber in which there is a problem. It is obviously principally also possible to start the testing process for the respective devices or also parts thereof by manual selection and to check specific components directly and by avoiding an automatic procedure.

Preferably, the compressed-air device comprises at least one compressed-air line, via which the compressed air can be transported from a compressed-air generator or compressed-air reservoir to at least one part of the inlet device and/or the outlet device.

Preferably, the compressed-air device is in fluidic connection via at least one control device and especially a triggerable valve device with the inlet device and/or the outlet device or the parts of the respective device that need to be supplied with compressed air, i.e., the respective inlet nozzles and/or outlet nozzles. The triggering of the control device can occur in a manual, wire-bound or wireless manner, for example. The control device allows supplying the respective device or the respective component of the inlet device and/or the outlet device with compressed air in a purposeful way. It is thus possible, for example, to connect the compressed-air device with the inlet device via a compressed-air line and to integrate in said compressed-air line a triggerable control device and especially a valve device. Compressed air can be supplied to the inlet device via the compressed-air line when the valve device is opened. Such an arrangement is obviously also possible in the outlet device.

The control device can principally also be arranged in the inlet device or outlet device in such a way that the supply of compressed air is possible via the line system which is used otherwise for supplying the respective reaction substances, i.e., water or bitumen, for example. A control device can be arranged, for example in the feed line of the reaction chamber used for feeding reaction water, which control device allows the purposeful supply of compressed air.

A central compressed-air supply line is preferably provided in an apparatus with a plurality of mixing devices, which central compressed-air supply line is in fluidic connection with the compressed-air device and from which the individual secondary compressed-air supply lines branch off to the inlet and/or outlet devices, with the control devices being provided in the secondary compressed-air supply lines. The respective inlet and/or outlet devices or the respective components of the devices can be supplied with compressed air via these control devices in a purposeful manner.

Preferably, at least one pressure sensor device is provided for the detection of the pressure curve of the pressure stream in the inlet and/or outlet device. Such a pressure sensor device can be provided, for example, in a central compressed-air supply line, so that it is suitable for the detection of the pressure curve in any of the components of the inlet and/or outlet devices to be checked.

It is possible, for example, to provide a central compressed-air supply line with such a pressure sensor and a central closing valve, so that a complete closure of the compressed-air system is possible after supplying the central compressed-air supply line and the secondary compressed-air supply lines which branch from the former (when the control devices in the respective secondary compressed-air supply lines are closed). The compressed-air sensor shows a constant unchanged pressure curve in such a state, i.e., when the valves are closed on all sides. When the testing process is performed, at least one control device is opened, e.g., a valve on a nozzle of the inlet device, and the pressure curve is detected by the pressure sensor. Once the pressure curve decreases in conformity with a reference pressure curve, the respective component can be classified as functional. If the pressure drop deviates from a reference pressure drop, the component must be classified as a malfunctioning component. Once the test has been performed on this component, the respective control device is closed again, the valve on the central compressed-air supply is opened and compressed air introduced into the line system again. The "compressed-air test" is performed in a further component or a group of components of the inlet and/or outlet device, etc.

It is obviously also possible in this connection to provide a continuous supply with compressed air, i.e., to feed compressed air continuously into the central compressed-air supply line for example. When the control devices are opened successively in the respective components to be checked, a drop in the compressed air is obtained despite the continuous conveyance of compressed air if the system works flawlessly. If there is clogging, there will be no or only reduced drop in pressure.

The reaction compressed-air device preferably also forms the compressed-air device at least in part in a reaction chamber of the apparatus in accordance with one embodiment of the present invention, in which compressed air is mixed together as a reaction fluid with the hot bitumen via a reaction compressed-air line for forming the foamed bitumen. It should be noted in this connection that any gaseous fluid is understood as being the reaction fluid of "compressed air" which can be supplied as a reaction product to the reaction chamber and can be used for forming foamed bitumen. The above therefore means that the device which supplies the air required for the production of the foamed bitumen is also used as a compressed-air device for the testing and optionally cleaning process. In this case, a central compressed-air supply line can also be a central reaction compressed-air supply line. Control devices are principally provided in such an embodiment which supply the reaction compressed air of the reaction compressed-air device to the respective components of the inlet and outlet devices during the testing process and optionally during the cleaning process, e.g., to the reaction water nozzles and the bitumen nozzles.

Preferably, a closed-loop control device is provided in a plurality of mixing devices, which closed-loop control device is in operative connection with the control devices of the mixing devices in such a way that it allows the simultaneous or individual or group-wise supply of the inlet and/or outlet devices of the mixing chamber with the compressed-air stream. The closed-loop control device is therefore arranged in such a way that it allows the specific control of the respective components of the inlet or outlet device to be checked during the testing process, for example, in order to check every single nozzle of the inlet and outlet device, for example. However, the closed-loop control device is also arranged in such a way that it allows the simultaneous or group-wise supply of the respective components with compressed air, as is advantageous in the cleaning process, for example. The individual or group-wise supply of components with compressed air is advantageous for increasing the respective cleaning pressure.

A closed-loop control device is preferably provided which may under certain circumstances also be the previously described closed-loop control device and which allows the activation and deactivation of the compressed-air device and/or the control device depending on an activation and/or deactivation signal. The automated arrangement of the apparatus in accordance with one embodiment of the present invention is possible by means of such an embodiment. The mentioned activation and/or deactivation signals can be manual signals which are initiated by the operator of the apparatus, or also sensor signals which are detected by suitable sensors.

At least one operating sensor device is preferably provided for this purpose, which detects the operating state of the apparatus, especially operating breaks and/or the end of operation and/or a temperature of the component and/or a manual activation and/or deactivation signal of the apparatus or similar states or signals, and forwards the detected values to the closed-loop control device for generating the activation or deactivation signal for the at least one compressed-air device and/or for triggering the control devices.

Thus, the operating sensor device can, for example, be an operating sensor which detects the temperature of one or several inlet nozzles. When the temperature drops beneath a specific nozzle temperature, an activation signal is sent to the closed-loop control device which thereupon initiates a testing process and/or a cleaning process.

The described operating sensor device can also be a sensor element which detects an operating break or an end of operation of the apparatus in order to initiate a cleaning and/or testing process as a preventative measure against clogging.

BRIEF DESCRIPTION OF THE DRAWINGS

The present invention will be explained below by reference to embodiments shown in closer detail in the enclosed drawings, wherein.

DETAILED DESCRIPTION OF THE INVENTION

Figure 1:
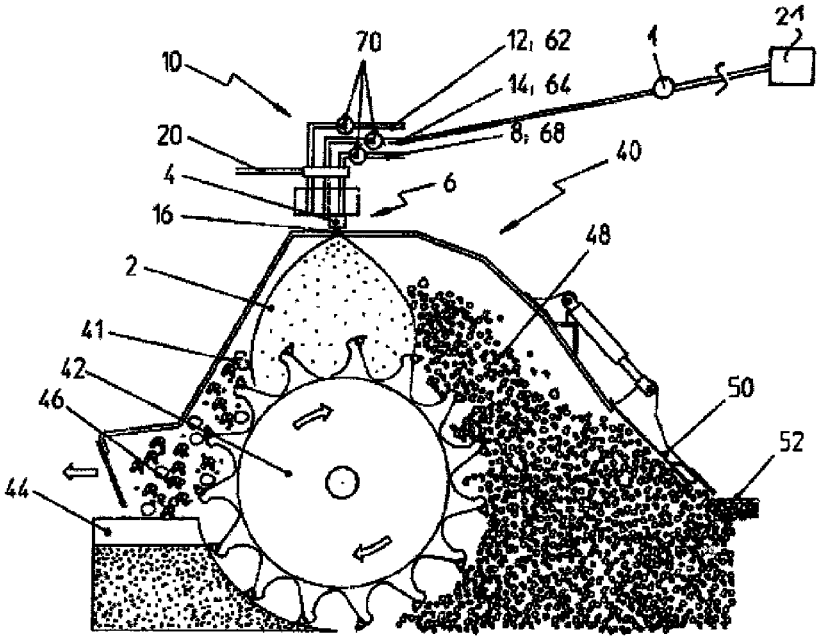
FIG. 1 shows a schematic view of an embodiment of a road construction machine.

Identical reference numerals will be used in the description below for identical or identically acting parts, with superscripts occasionally being used for differentiation.

FIG. 1 shows a schematic view of a road construction machine and especially a recycling machine for upper road structures in road construction.

The illustrated road construction machine 40 comprises a milling wheel 42 in a rotation chamber 41, by means of which the existing road surface 44 can be milled off, the milled material can be crushed and processed into a new road surface 52. The milled raw material 46 is mixed for this purpose with the foamed bitumen 2, so that a bonded raw road material 48 is obtained which is applied by a smoothing apparatus 50 of the road construction machine 40 onto the base of the old road surface 44 and can be smoothed and compressed into a finished road support layer 52. The final road surface, especially an asphalt cover layer, can then be applied to the road support layer 52.

In order to mix the raw material 46 with the foamed bitumen 2 in the rotation chamber 41, a mixing device 6 is arranged relative to the rotation chamber 41 in such a way that foamed bitumen 2 which is mixed in the mixing device 6 can be sprayed directly onto the raw material 46.

For this purpose, a part of an outlet device 16 of the mixing device 6 protrudes into the interior space of the rotation chamber 41. The outlet device 16 is in connection with a reaction chamber 4 of the mixing device 6, in which the raw materials of the finished foamed bitumen 2, which are the reaction fluids such as water 12, air 14 and bitumen 8, are mixed together. These reaction fluids 12, 14 and the bitumen 8 are injected into the reaction chamber 4 of the mixing device 6 by a respective inlet device 10.

Figure 2:
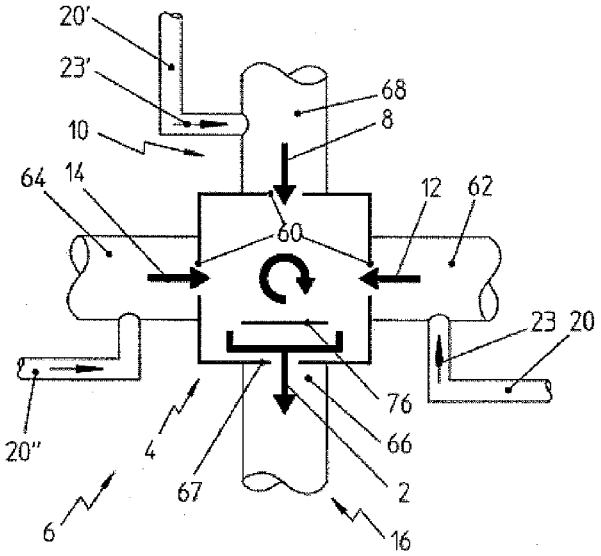
FIG. 2 shows a schematic view of an embodiment of an apparatus for producing foamed bitumen for a road construction machine according to FIG. 1.

The structure of the reaction chamber 4 of the mixing device 6 is shown in detail in FIG. 2. The mixing device 6 comprises the reaction chamber 4, into which the inlet device 10 opens and from which the outlet device 16 branches off.

The inlet device 10 comprises three inlet lines in this case, which are a water inlet line 62, an air inlet line 64 and a bitumen inlet line 68. Each inlet line comprises an inlet nozzle 60 which allows the metered injection of the respective reaction fluids 12, 14 and the bitumen 8.

As schematically shown in FIG. 1, the respective inlet lines 62, 64, 68 and the inlet device 10 each comprise valves 70 which allow the open-loop or closed-loop control of the supplied reaction fluids and bitumen quantities.

The supplied water 12 will distribute very finely over a large area by the injection of the reaction fluids 12, 14 into the reaction chamber 4, whereupon it evaporates upon contact with the hot bitumen 8 and forms a bitumen foam 2 which is discharged via an outlet line 66 with outlet nozzles 67 of the outlet device 16 from the mixing device 6 or the reaction chamber 4 and can be supplied to the rotation chamber 41.

In order to prevent that the regions of the apparatus will clog which come into contact with the hot bitumen that will solidify during a temperature drop, a compressed-air device 20 is provided in accordance with the present invention, which allows checking the free passage of the respective inlet and outlet devices and their cleaning. The compressed-air device 20 is in operative connection with the inlet device 10 and the outlet device 16 in such a way that a supply of these devices with compressed air and especially the respective inlet lines 62, 64, 68, the outlet line 66 and the respective nozzles 60 and 67 is possible.

This compressed-air device can be used to perform both a testing process and a cleaning process, as will be described below in closer detail.

The baffle plate 76 was provided so that the bitumen which was introduced into the reaction chamber via the inlet line 68 is unable to exit again directly through the outlet nozzle. The bitumen jet is atomized in this way. The bitumen remains longer in the reaction chamber and is able to foam much better.

Independently of the devices for testing and maintenance of those line and nozzle components which come into contact with bitumen, an air compressor 21 also supplies compressed air to the reaction chamber 4 via air inlet lines 64, with the compressed air being used for foaming the bitumen. Since the air pressure required for this is lower than the air pressure required for testing and cleaning, a pressure reducing valve 1 is installed in these air inlet lines 64 upstream of the reaction chamber 4, which pressure reducing valve is shown schematically in FIG. 1.

FIGS. 3*a* to 3*c*, 4 and 5 show a schematic view of a testing process for maintaining the apparatus as described above.

The apparatus in accordance with one embodiment of the present invention for producing foamed bitumen for a road construction machine is only shown schematically here. Not all components previously shown in FIGS. 1 and 2 are shown for reasons of clarity of the illustration. The drawings show five mixing devices 6, in the reaction chambers 4 of which several reaction fluids 12, 14 and bitumen 8 are mixed into foamed bitumen (also see FIGS. 1 and 2 in this connection and below). As already mentioned, the reaction fluids 12, 14 and the bitumen 8 are injected via the inlet device 10 into the reaction chamber 4, are mixed there and supplied via the outlet device 16 to the rotation chamber 41 of the road construction machine 40. Only a part of the inlet device 10 is shown for reasons of clarity in FIGS. 3*a* to 3*c*, 4 and 5, which is the water inlet line 62 for the reaction fluid water 12. The process steps for testing the other parts 14, 8 of the inlet device 10 are identical however.

In accordance with one embodiment of the present invention, each mixing device 6 and each reaction chamber and the inlet devices 10 and the outlet devices 16 which are arranged thereon are in fluidic connection with a compressed-air device 20, by means of which testing and maintenance of the line and nozzle components which are in contact with the bitumen are possible. The compressed-air device 20 comprises an air compressor or a similar compressed-air supply 21 for this purpose, by means of which compressed air 23 can be guided via a central compressed-air line 32 to the secondary compressed-air lines 34. Each secondary compressed-air line 34 opens into a control device 30 which in form of a controllable valve allows the injection of the compressed air supplied via the compressed-air device 22 into the respective inlet device, which is the water inlet device 62 in this case. Instead of the reaction fluid water 12 (see FIG. 2), compressed air 23 of the air compressor 21 is injected through the water inlet line 62 into the reaction chamber 4 when valve 30 is opened.

In addition to the control devices 30 for injecting the compressed air of the compressed-air device 20 into the inlet device 10 or the water inlet line 62 in this case, two further main valves 72, 74 are provided on the central compressed-air line 32 which enable the introduction and the discharge of the compressed air 23 into the central compressed-air line 32 or the secondary compressed-air lines 34. It is also possible instead of the valve 74 to seal off the central compressed-airline 32 permanently at this end.

Figure 3A:
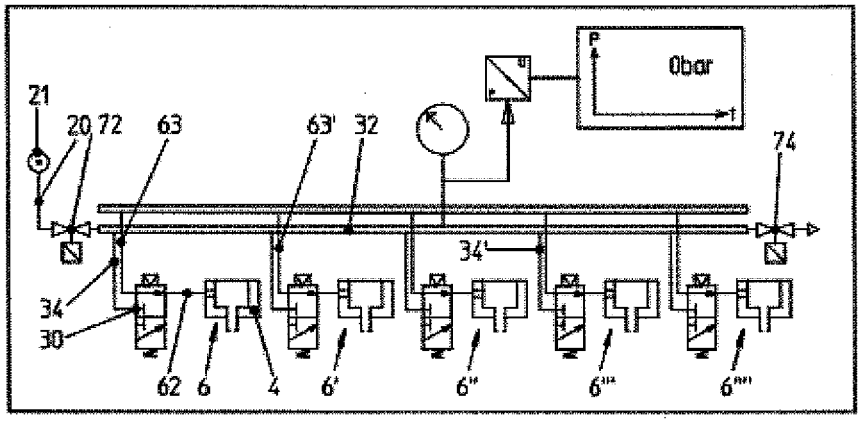
FIG. 3*a* shows a schematic view of a testing process for maintaining the apparatus according to FIG. 2 prior to the start of testing.

FIG. 3*a* schematically shows the apparatus for producing foamed bitumen shortly before activation of the testing process, which in this case is shown with deactivated compressed-air supply 20 and deactivated air compressor 21.

Figure 3B:
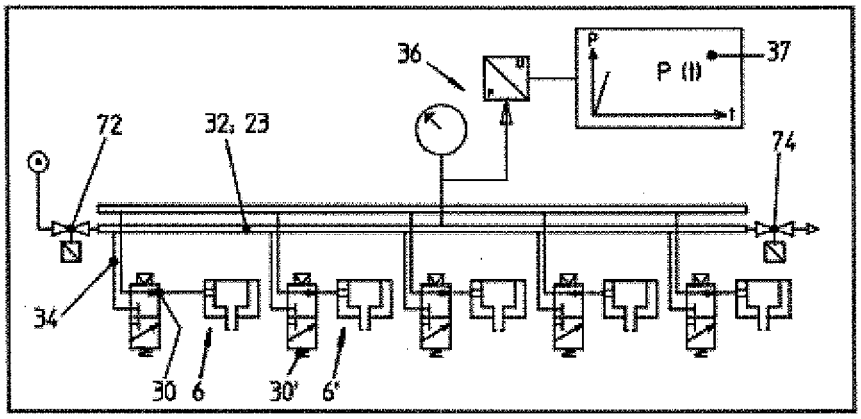
FIG. 3*b* shows a schematic view of the testing process according to FIG. 3*a* shortly after the beginning of the testing.
Figure 3C:
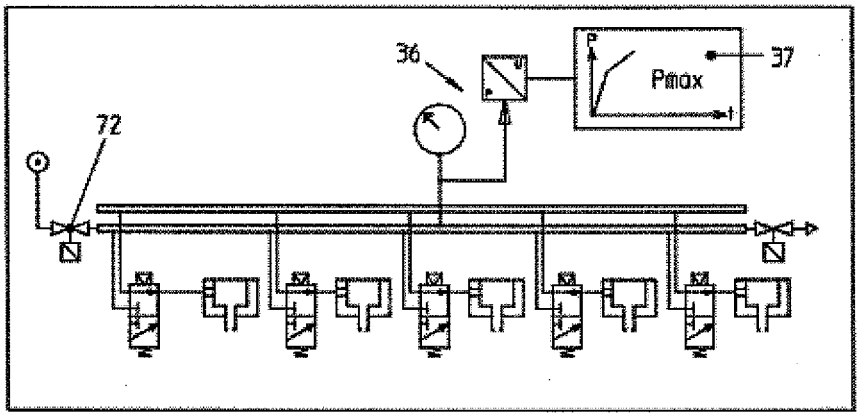
FIG. 3*c* shows a schematic view of the testing process according to FIG. 3*a* upon reaching the maximum testing pressure.

As is shown in FIG. 3*b*, valve 74 is closed upon activation of the testing process, valve 72 is opened and compressed air 23 is supplied, so that the entire central compressed-air line 32 will fill with compressed air 23. Since all control devices 30 of the respective mixing devices 6 are closed, a pressure p builds up evenly, as shown in FIGS. 3*b* and 3*c*. This pressure is shown in a display 37 of a pressure sensor device 36. Once the required maximum pressure has been obtained in the central compressed-air line 32 and the secondary compressed-air lines 34, valve 72 is closed (see FIG. 3*c*), so that a closed system is formed. The display 37 of the pressure sensor 36 shows a reference or testing pressure $p_{max}$ in this state.

Once this testing pressure has been reached and the system is completely closed, a verification of the free passage of the water inlet lines 62 and their nozzles 60 can be performed by the purposeful opening or activation of the respective control devices 30. A control device 30 is opened for this purpose, as is shown in FIGS. 4 and 5, for example, whereas the remaining control devices 30' to 30"" remain closed.

Figure 4:
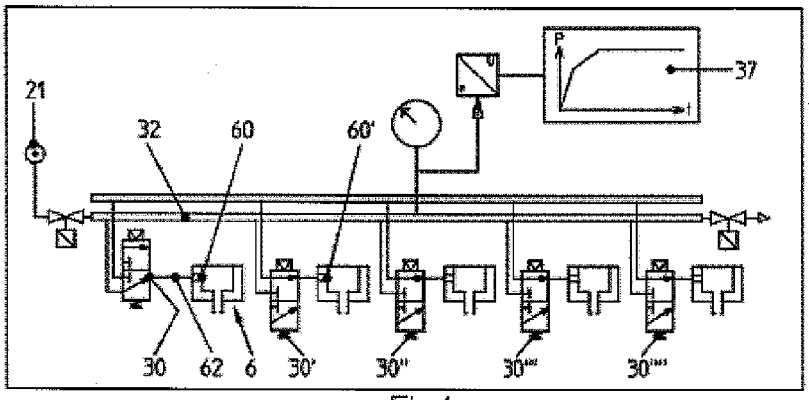
FIG. 4 shows a schematic view of the testing process according to FIG. 3*a* when there is a malfunction of the apparatus.
Figure 5:
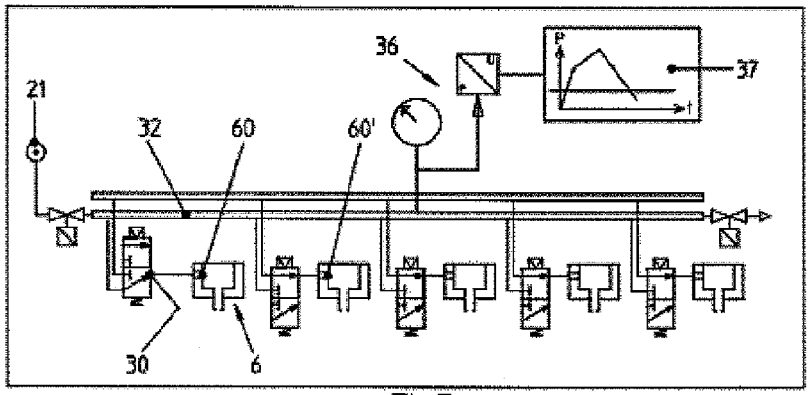
FIG. 5 shows a schematic view of the testing process according to FIG. 3*a* when the apparatus works properly.

Depending on whether or not the water inlet line 62 or nozzle 60 which is in fluidic connection with the central compressed-air line 32 offers free passage, a different pressure curve can be observed in the display 37 (see FIGS. 4 and 5).

As is shown in FIG. 5, the built-up air pressure will drop evenly via the nozzle 60 when the control device 30 is opened. This is shown in the display 37 of the pressure sensor device 36.

Once a component of the inlet device 10, which is the water inlet secondary line 62 or its nozzle 60, is clogged there will be no or only reduced pressure drop, as is shown in FIG. 4. Nozzle 60 is clogged here in such a way that the air pressure applied via the pressure device 20 does not or only insignificantly decrease. This allows drawing a direct conclusion on a malfunction and clogging of the inlet device 10 or the outlet device 16.

A diagnosis of the outlet device is also principally directly possible via the pressure curve on the pressure display 37. If the pressure in the display apparatus 37 drops briefly and then stagnates after the opening of the control device 34 example, this allows drawing the conclusion that the water inlet line 62 and its nozzle 60 allow free passage, whereas the outlet device 16 or its outlet line 66 are clogged (FIG. 2). Depending on the size of the reaction chamber volume of the reaction chamber 4, the observed brief pressure drop is either larger or smaller.

As soon as the check of the inlet device 10 for water as shown here has been completed, it is possible to subsequently check the further components of the inlet device, e.g., for the injection of air and bitumen. Once the mixing device 6 has been checked completely, there will be a check of the next following mixing device, etc. It is obviously also possible to select a mixing chamber to be checked in a purposeful manner or the respective components of the respective device.

Performing a successive check, i.e., each individual component successively, offers the advantage that precise error diagnosis and fault localization is possible in a very simple and rapid way.

As soon as a deviation of the pressure curve in display 37 from a reference pressure curve has been detected during the testing process, an activation signal can be output via a respective signaling device in order to start a cleaning process, for example, as will be explained below in further detail.

When performing the cleaning process, a compressed-air blast is simultaneously applied via the compressed-air device 20 to all inlet devices 10 and/or outlet devices 16, so that the respective components are cleared from any adhering bitumen residues. Preferably, this process is performed right at the beginning of a working break, after certain working intervals, or during the maneuvering of the machine. The respective components are "blasted free" by application of a compressed-air blast. This blasting free does not only lead to cleaning of the respective lines and nozzles, but also to cleaning of the reaction chamber 4 and possibly also the rotation chamber 41. It is obviously possible to perform the cleaning process not only during the detection of a malfunction (after the testing process), but also manually or after the detection of an activation signal.

In order to increase the cleaning performance it is also possible in this connection to subject the respective components to a compressed-air blast in a grouped manner. It is possible, for example, to open all valves 72 and control devices 30 after the detection of a malfunction, to apply a compressed-air blast to all parts of the inlet and outlet devices 10, 16 via the air compressor 21, then to perform a testing process again and, if there is still a malfunction, to apply an increased compressed-air blast only to a specific part of the inlet and outlet devices 10, 16. This increases the pressure on the respective component and thus the cleaning effect.

The above triggering of the individual components can be performed by way of a closed-loop control device which is preferably integrated in the control system of the apparatus in accordance with one embodiment of the present invention. This closed-loop control device can receive signals on the operating state, working temperature, interval length, working brakes, resumptions of work or the complete shutdown of the machine via suitable operating sensors and can then start respective testing or cleaning processes. Respective manual signals can also be provided to the closed-loop control device by the operator of the machine.

Figure 6:
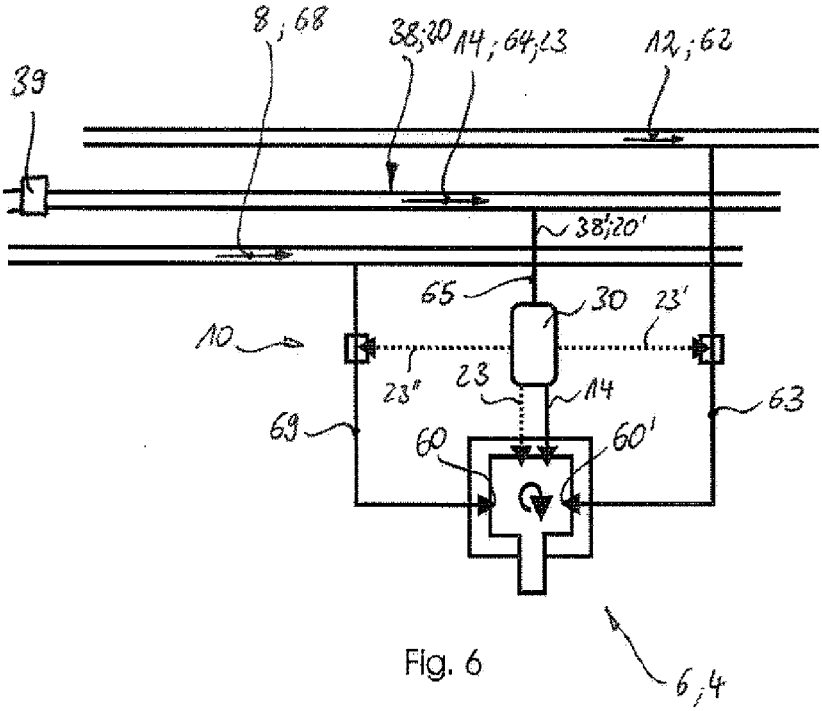
FIG. 6 shows a schematic view of a further embodiment of an apparatus for producing foamed bitumen.

FIG. 6 shows a schematic view of a further embodiment of the apparatus in accordance with the present invention, which also shows a mixing device 6 with the reaction chamber 4, in which reaction fluids (water 12 and air 14) and bitumen 8 are injected by means of an inlet device 10. The reaction fluids 12, 14 and the bitumen 8 are introduced into the reaction chamber 4 again by means of respective inlet lines 62, 64, 68. The supply with reaction compressed air is ensured by way of a reaction compressed-air device 38 which generates its reaction compressed air 14 via an air compressor 39.

In accordance with the present invention, the reaction compressed-air device 38 also forms the compressed-air device 20 which is used to perform the testing and/or cleaning process in accordance with the present invention.

A control device 30 is provided for this purpose in the air inlet secondary line 65 which supplies compressed air 23 or reaction compressed air 14 into the remaining parts of the inlet device 10, which are the water inlet secondary line 63 and the bitumen inlet secondary line 69. Virtually any part of the inlet device 10 can be supplied with compressed air 14 via the control device 30 for the purpose of performing the testing and cleaning process in accordance with the present invention. In accordance with one embodiment of the present invention, the reaction compressed-air device 38 then obviously comprises a pressure sensor (not shown) in order to detect the pressure curve during the performance of the respective testing and cleaning steps. All other devices necessary for performing the process are then preferably provided.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. In combination, a road construction machine and an apparatus for producing foamed bitumen, the apparatus comprising:

at least one mixing device having a reaction chamber in which hot bitumen and at least one reaction fluid can be mixed together via an inlet device and can be discharged from the at least one mixing device via an outlet device;

at least one first compressed-air device which supplies compressed air to the reaction chamber via the inlet device, with the compressed air being used for foaming the bitumen; and at least one second compressed-air device in operative connection with the inlet device, via which the inlet device is subjected directly to a compressed-air stream for testing and/or cleaning purposes independently of the first compressed-air device, wherein the pressure of the compressed air for foaming the bitumen is lower than the pressure of the compressed-air stream for testing and/or cleaning purposes.

2. An apparatus according to claim 1, wherein the at least one second compressed-air device is brought into fluidic connection with the inlet device and/or the outlet device via at least one control device.

3. An apparatus according to claim 2, further comprising a plurality of mixing devices, wherein the at least one second compressed-air device comprises a central compressed-air line from which individual secondary compressed-air lines branch off to the inlet and/or outlet devices of the plurality of mixing devices, with a plurality of control devices being arranged in the secondary compressed-air lines.

4. An apparatus according to claim 1, wherein at least one pressure sensor device is provided for detection of a pressure curve of the compressed-air stream in the inlet device and/or outlet device.

5. An apparatus according to claim 4, further comprising reaction compressed air being mixed together via a reaction compressed-air device as a reaction fluid with the hot bitumen in the reaction chamber, wherein the reaction compressed-air device forms at least part of the at least one second compressed-air device.

6. An apparatus according to claim 2, further comprising a plurality of mixing devices, wherein a closed-loop control device is provided which is in operative connection with the at least one control device in such a way that it allows the simultaneous or individual supply of the inlet and/or outlet devices with the compressed-air stream.

7. An apparatus according to claim 2, wherein a closed-loop control device is provided which allows the activation and/or deactivation of the at least one second compressed-air device and/or the at least one control device depending on an activation and/or deactivation signal.

8. An apparatus according to claim 7, wherein at least one operating sensor device is provided which detects the operating state of the apparatus comprising at least one of operating breaks and/or an end of operation and/or a temperature of a component and/or a manual activation and/or deactivation signal of the apparatus, and forwards the detected operating state to the closed-loop control device for generating the activation or deactivation signal for the at least one second compressed-air device and/or the at least one control device.

9. An apparatus according to claim 1, wherein the at least one control device comprises a triggerable valve device.

10. A method for maintaining an apparatus according to claim 1, comprising the following steps of a testing process:

supplying the inlet and/or outlet devices with a compressed-air stream;

detecting a pressure curve of the compressed-air stream in the inlet and/or outlet device, and comparing the detected pressure curve with a predetermined reference pressure curve, with any deviation of the pressure curve from the reference pressure curve indicating a malfunction of the inlet and/or outlet device.

11. A method according to claim 10, further comprising a plurality of mixing devices, wherein the supply of the individual inlet and/or outlet devices with the compressed-air stream occurs successively in the testing process.

12. A method according to claim 10, wherein the steps of the testing process are performed automatically when detecting an operating break and/or an end of operation of the apparatus and/or when a temperature of a component falls below a specific component temperature.

13. A method according to claim 10, wherein a cleaning process is performed upon detecting a malfunction in the testing process and/or preventively, further comprising the steps:

simultaneously supplying all and/or individually supplying the inlet and/or outlet device with a compressed-air stream.

14. A method according to claim 13, wherein the cleaning process is performed automatically upon detecting a malfunction and/or upon start-up of the apparatus and/or upon detecting an operating break and/or an end of operation of the apparatus and/or when a temperature of a component falls below a specific component temperature.

15. A method according to claim 10, wherein the malfunction comprises a clogging of the inlet and/or outlet device.

* * * * *